US005092066A

United States Patent [19]

Brewster

[11] Patent Number: 5,092,066

[45] Date of Patent: Mar. 3, 1992

[54] REMOVABLE SIGN

[76] Inventor: Blair M. Brewster, 285 Westminster Rd., Rochester, N.Y. 14607

[21] Appl. No.: 590,496

[22] Filed: Sep. 27, 1990

Related U.S. Application Data

[63] Continuation of Ser. No. 350,128, May 10, 1989.

[51] Int. Cl.[5] ..... G09F 7/22

[52] U.S. Cl. ..... 40/617; 40/611; 248/692

[58] Field of Search ..... 40/611, 617, 308, 316, 40/317, 642, 661, 309, 310; 248/692, 693, 74.2; 24/129 R, 129 B, 129 D

[56] References Cited

U.S. PATENT DOCUMENTS

| | | | |
|---|---|---|---|
| 407,636 | 7/1889 | Browne | 40/617 |
| 1,241,302 | 9/1917 | Taylor | 40/316 |
| 2,282,872 | 5/1942 | Mayer et al. | 40/661 |
| 2,723,816 | 11/1955 | Drysdale | 40/617 |
| 2,886,907 | 5/1959 | Stephenson | 40/661 |
| 2,888,761 | 6/1959 | Miller | 40/308 |
| 3,464,135 | 9/1969 | Edinger | 40/661 |
| 3,964,197 | 6/1976 | Tucker et al. | 40/611 |
| 4,089,129 | 5/1978 | Patterson, Jr. | 40/617 |
| 4,240,543 | 12/1980 | McKee | 40/661 |
| 4,422,852 | 12/1983 | Mathias | 40/617 |
| 4,685,785 | 8/1987 | Mundt et al. | 40/642 |
| 4,760,660 | 8/1988 | Fast | 40/316 |
| 4,761,904 | 8/1988 | Fast et al. | 40/308 |
| 4,899,474 | 2/1990 | Piana et al. | 411/316 |
| 4,941,434 | 7/1990 | Ellwanger | 24/129 B |

FOREIGN PATENT DOCUMENTS

| | | | |
|---|---|---|---|
| 2167223 | 5/1986 | United Kingdom | 40/316 |

*Primary Examiner*—Kenneth J. Dorner
*Assistant Examiner*—Brian K. Green
*Attorney, Agent, or Firm*—Cumpston & Shaw

[57] ABSTRACT

A sign adapted to be attached to a rope includes a legend receiving body portion, and a rope engaging portion including an opening having a minimum dimension at least equal to the diameter of the rope, the opening communicating with the outside periphery of the rope engaging portion by a slot having a width smaller than the diameter of the rope, the rope engaging portion comprising an ear formed from a resilient material having a fixed end attached to the body portion and a free end bordered by the slot and displacable for enlarging the width of the slot and allowing the rope to be passed through the slot into the opening.

6 Claims, 2 Drawing Sheets

REMOVABLE SIGN

This is a continuation of copending application(s) Ser. No. 07/350,128 filed on May 10, 1989.

This invention relates in general to signs and more particularly to a sign especially adapted to be hung from a rope or similar barrier for warning or alerting entrants to possibly hazardous conditions within the area guarded by the barrier.

Ropes, chains, wires and the like are widely used to form temporary barriers to guard the entrances to hazardous areas. As used herein, rope will be understood to refer not only to rope, but chains, wires and any similar elongated element used to guard an area. It is desirable to be able to attach a sign to such a barrier to give more information about the conditions within the guarded area.

Heretofore, signs for attachments to rope barriers have been provided with U-shaped brackets for receiving a wire, plastic tie wrap fastener or the like, for attaching the sign to the rope. While the known signs provide adequate functionality, they are clumsy to attach and difficult to remove. Other constructions suffer from the disadvantage that they do not hang straight, and therefore are difficult to read.

Accordingly, it is an object of this invention to provide a new construction for a sign adapted to be attached to a rope, that is easy to attach and remove, hangs straight, and is economical to produce.

Briefly stated, in accordance with a presently preferred embodiment of this invention, a sign adapted to be attached to a rope includes a legend receiving body portion, and a rope engaging portion including an opening having a minimum dimension at least equal to the diameter of the rope, said opening communicating with the outside periphery of said rope engaging portion by a slot having a width smaller than the diameter of the rope, said rope engaging portion comprising an ear formed from a resilient material having a fixed end attached to said body portion and a free end bordered by said slot and displacable for enlarging the width of the slot and allowing the rope to be passed through the slot into the opening.

Figure 1:
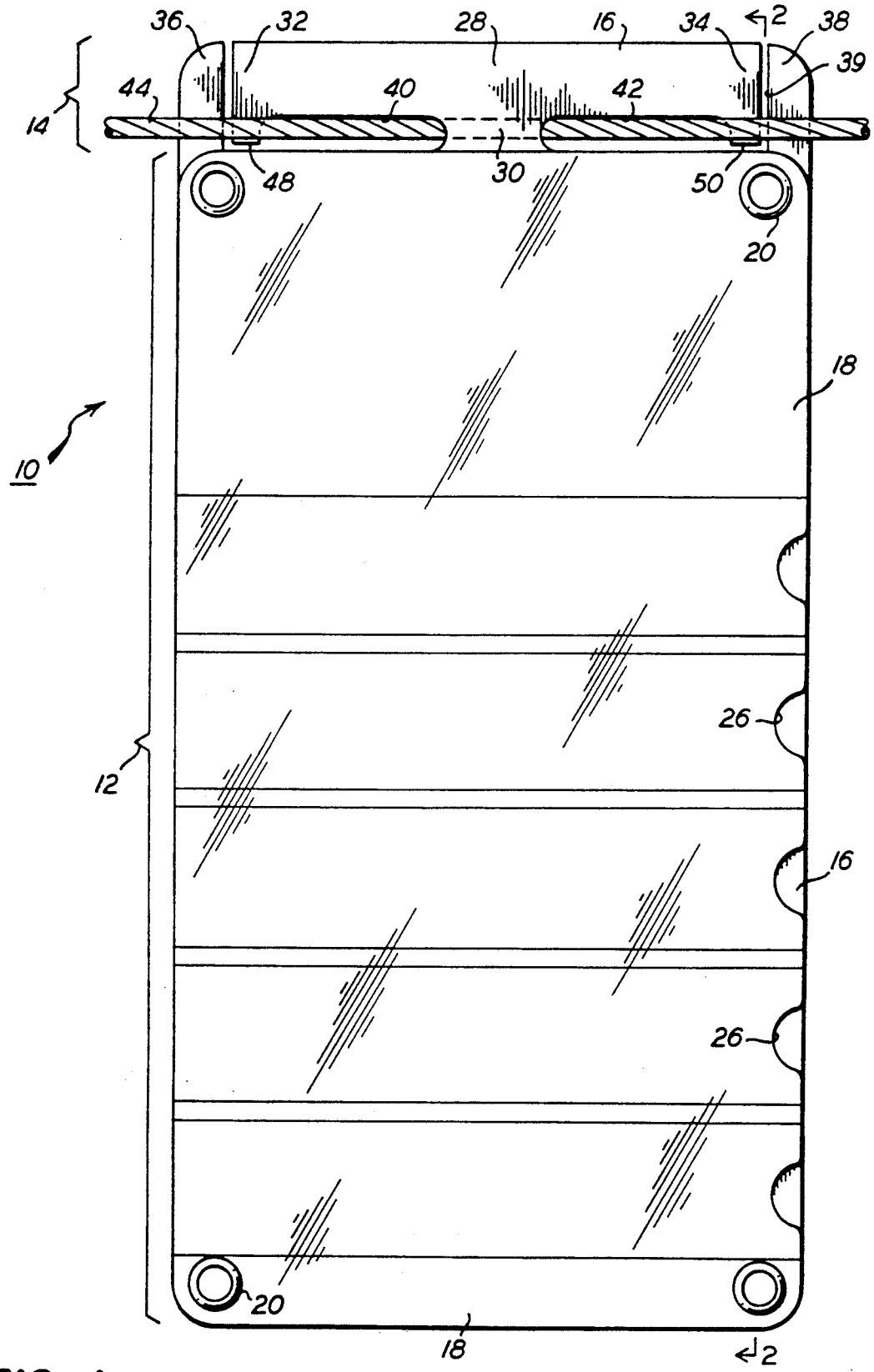
Figure 2:
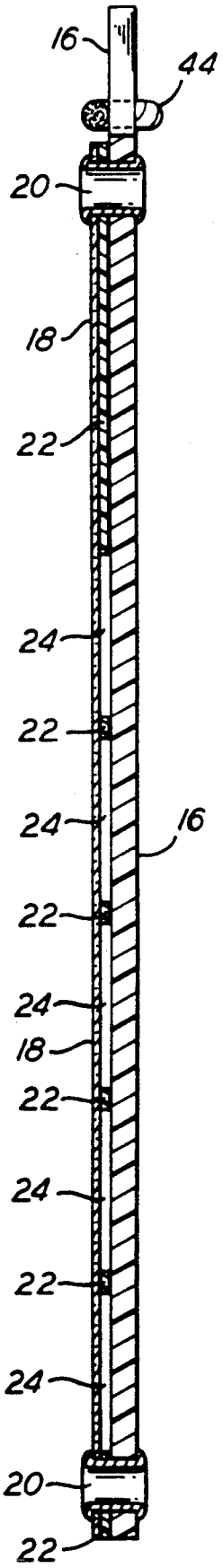

While the novel aspects of the invention are set forth with particularity in the appended claims, the invention itself, together with further objects and advantages thereof, may be more readily understood by referring now to the following detailed description of the invention, together with the accompanying drawings in which:

FIG. 1 is a front elevation of a hanging sign in accordance with this invention; and FIG. 2 is a section taken along line 2—2 of FIG. 1.

Referring now to the two FIGURES which are appropriately considered together, a hanging sign indicated generally at 10 includes a legend receiving body portion 12 and an adjacent rope engaging portion 14. A hanging sign in accordance with this invention is especially well suited to be suspended from a rope that is used to guard an area into which admittance is restricted. Often, such a rope barrier is erected between stanchions or pylons or the like.

The sign 10 includes a generally rectangular base member 16 that preferably has rounded corners. An at least partially transparent cover layer 18 is attached to base member 16 by rivets 20 or the like, and a plurality of channels are maintained therebetween by a multistrip spacer 22. As seen in FIG. 2, four sign strip receiving channels 24 are formed between the base and cover layers.

Preferably, base and cover layers 16 and 18 are provided with thumb holes 26 for allowing sign strips to be inserted into the spaces for displaying easily changed messages.

The rope engaging portion 14 of sign 10 has a generally T-shaped rope engaging center portion 28 having a stem 30 attached to the upper end of body portion 12 and first and second deflectable wings 32 and 34 respectively. The peripheral edges of the wings are slightly spaced from upstanding guard posts 36 and 38, from which the wings are separated by narrow slits 39. When the wings are bent, the slits enlarge to allow access to first and second rope receiving openings 40 and 42 that have a width sufficient to pass the rope 44 therethrough.

Preferably, the wings 32 and 34 have enlarged end portions 48 and 50 for ensuring that the sign will not accidentally fall off the rope, even in windy conditions.

In order to hang the sign on a rope, the wings 32 and 34 are displaced with respect to the plane of the sign, and the rope threaded through the openings. The flaps then resiliently return to their undisturbed positions. The posts 36 and 38 engage the rope 44 and prevent tension on the rope from forcing the wings to an open position that could allow the sign to blow off.

A selection of a suitable material for forming the sign and especially the base member 16 is critical to this invention. The material must satisfy a number of requirements. It must flex a multiplicity of times without cracking or creating a seam. The wings must be stiff enough to snap back into position even under adverse environmental conditions. The material must be easy to cut or stamp without shattering or weakening. The material must be resistant to long term exposure to ultraviolet radiation. The material must have a surface that can be printed upon, and which has surface characteristics compatible with adhesive tapes. The material must be heavy enough to hang vertically when suspended upon a rope, but not so heavy as to cause the rope to sag excessively. Applicants have found that polycarbonate sheet, such as LEXAN brand polycarbonate manufactured by General Electric Company meets the requirements of this invention. The polycarbonate material is selected to have a tensile strength of at least 9,000 psi; a tear strength measured in accordance with ASTM D1004 of 1,100 lbs per inch; a flexural deflexion temperature of 275° F. measured at 264 psi in accordance with ASTM D648; and a flammability rating of V-2 as set forth in UL Standard 94. Preferably, cover layer 18 is a clear polycarbonate sheet having a thickness of 0.030 inches. The layers of the sign are preferably bonded with white acrylic foam adhesive, having a peel strength measured in accordance with PSTC-1 of 240 ounces per inch; and a shear strength measured in accordance with PSTC-7 (4) psi of in excess of 5,000 min.

Preferably, the sign strips are constructed either from 0.010 inch thick polyester or 0.020 inch thick polycarbonate. The thinner polyester material is advantageously used when two inserts are stacked on top of each other, the thicker polycarbonate material used when only a single insert is employed.

While the invention has been described in connection with a presently preferred embodiment thereof, those skilled in the art will recognize that any modifications and changes may be made therein without departing from the true spirit and scope of the invention, which accordingly is intended to be defined solely by the appended claims.

What is claimed is:

1. A generally flat hanging sign adapted to be suspended from a rope, comprising:

a planar legend receiving body portion;

a layer of clear material attached in parallel spaced, sandwich like relationship with said legend receiving body portion and a plurality of spacers disposed between the layer of clear material and the legend receiving body portion for forming sign strip receiving chambers between the layer of clear material and the legend receiving body portion;

a T-shaped rope engaging portion defined by slits in and co-planar with the body portion and having a first and a second planar side, the rope engaging portion extending from the body portion and defining first and second openings between the rope engaging portions and the body portion, each of the openings extending completely through the plane of the body receiving portion and having a dimension at least equal to the diameter of said rope for passing said rope therethrough;

the T-shaped rope engaging portion comprising first and second deflectable wings adjacent said first and second openings, said wings having end portions extending towards the body portion for at least partially closing said first and second openings for retaining the rope therein, and movable in a direction generally perpendicular to the planar body portion to a first position for forming a gap between each rope engaging portion and the body portion such that the rope may be passed into the openings from the first or the second planar side of the rope engaging portions and to a second position co-planar with the body portion for retaining said rope in said opening whereby said sign is suspended from said rope.

2. A hanging sign adapted to be suspended from a rope comprising:

a legend receiving sign body;

a T-shaped rope engaging member having a stem portion attached to an edge of said sign body and first and second displaceable wings extending outwardly from said stem portion and defining an opening between said wings and said edge, said opening having a width sufficient to pass said rope therethrough, and including first and second rope engaging ends extending from said wings towards said edge; and first and second rope engaging guard posts extending outwardly from said edge adjacent to said ends.

3. The sign of claim 2 wherein said rope engaging member comprises a sheet of polycarbonate resin material.

4. The sign of claim 3 wherein said first and second displaceable wings together comprise the T-shaped rope engaging member and are defined by slits in said sheet of polycarbonate resin material.

5. The sign of claim 3 wherein said legend receiving sign body is an extension of said sheet of polycarbonate resin material adapted to be suspended below said rope.

6. The sign of claim 5 further comprising a layer of clear material attached in parallel spaced, sandwich relationship with said legend receiving sign body and a plurality of spacers disposed between the layer of clear material and the legend receiving sign body for forming sign strip receiving chambers between the layer of clear material and the sign body.

* * * * *